US006589391B2

(12) United States Patent
Vogel et al.

(10) Patent No.: US 6,589,391 B2
(45) **Date of Patent: *Jul. 8, 2003**

(54) TOP SEPARATOR WITH INTRASEAL FOR DIGESTER VESSEL IN A PULP OR FIBER PROCESSING SYSTEM

(75) Inventors: Keith P. Vogel, Queensbury, NY (US); John F. Bolles, Queensbury, NY (US); C. Bertil Stromberg, Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/984,335

(22) Filed: Oct. 29, 2001

(65) Prior Publication Data

US 2002/0074101 A1 Jun. 20, 2002

Related U.S. Application Data

(60) Provisional application No. 60/256,345, filed on Dec. 19, 2000.

(51) Int. Cl.[7] ..... D21C 7/06

(52) U.S. Cl. ..... 162/246; 162/245; 162/248; 162/17; 277/510; 277/306; 277/318; 277/345

(58) Field of Search ..... 162/246, 245, 162/248, 17; 277/318, 345, 510, 306

(56) References Cited

U.S. PATENT DOCUMENTS 5,690,341 A * 11/1997 Prough et al. ..... 277/9

* cited by examiner

*Primary Examiner*—Steven P. Griffin
*Assistant Examiner*—M. Halpern
(74) *Attorney, Agent, or Firm*—Nixon & Vanderhye P.C.

(57) ABSTRACT

A top separator assembly for a digester is disclosed comprising: a rotatable shaft for the top separator; a packing for the shaft; and a sealing ring operatively mounted to the shaft and having a nominal clearance with the pack box, said sealing ring mounted so that up lifting of said shaft provides a substantially fluid tight seal between said pack box and a side of said ring (in the digester) opposite the pack box.

15 Claims, 6 Drawing Sheets

*Fig. 1* *(PRIOR ART)*

TOP SEPARATOR WITH INTRASEAL FOR DIGESTER VESSEL IN A PULP OR FIBER PROCESSING SYSTEM

RELATED APPLICATION

Priority is claimed to U.S. Provisional Patent Application Ser. No. 60/256,345, filed Dec. 19, 2000, the entirety of which application is incorporated by reference herein.

BACKGROUND OF THE INVENTION

A top separator is a conventional device in a continuous digester that separates cellulosic fibrous material in a slurry (typically from a high pressure feeder) from some of the liquid of the slurry, and returns the separated liquid to upstream equipment (such as the high pressure feeder). Examples of top separators are shown in U.S. Pat. Nos. 5,413,677; 6,024,837; and 6,086,717 the disclosures of which are hereby incorporated by reference herein.

Conventional top separators 10 are mounted on the top of a digester vessel 16 and are sealed by a packing 12 around a top separator shaft 14 to the digester. The packing seals the pressurized slurry in the digester vessel. Packing is usually a lubricated series of rings, such as five rings. From time to time, the packing needs to be replaced or refurbished in order to maintain a good seal of the pressurized digester vessel.

A problem with the current design is that the digester vessel must be emptied of the slurry to refurbish or replace the packing 12. Emptying the digester is a time-consuming and expensive proposition. FIG. 1 shows a side schematic view, partly in cross-section and partly in elevation, of a conventional packing for a top separator. FIG. 2 is a view like that of FIG. 1, showing the conventional packing and its associated pack box 18 in greater detail.

The pack box 18 is an annular chamber around the shaft 14 that contains the packing 12. Lubricant may be added to the packing chamber and packing by a lubricant port 19 and through a lantern ring 21.

BRIEF DESCRIPTION OF THE INVENTION

In one embodiment, the invention is a top separator assembly for a digester comprising a rotatable shaft for the top separator; a packing for the shaft, and a sealing ring operatively mounted to the shaft and having a nominal clearance with the pack box. The sealing ring is mounted so that up-lifting of the shaft (while the shaft is not rotating and during digester maintenance) provides a substantially fluid-tight seal between the pack box and a side of the ring (in the digester) opposite the pack box. This fluid-tight seal by the sealing ring maintains the pressure of the contents of the digester vessel while the packing is replaced or refurbished.

In another embodiment, the invention is a top separator assembly for a digester, comprising: a rotatable shaft for the top separator assembly; a pack box including packing mounted around the shaft; and a sealing ring mounted on the shaft and having a nominal clearance with the pack box, said sealing ring mounted so that up-lifting of said shaft provides a substantially fluid-tight seal between said pack box, said ring and the digester.

In a further embodiment, the invention is a method for servicing packing material in a top separator assembly of a digester, said method comprising the steps of: lifting a shaft extending from the top separator assembly and into the digester; while lifting the shaft, creating a fluid-tight seal between a sealing ring mounted on the shaft and a pack box housing the packing material; refurbishing the packing material while maintaining a slurry in the digester under pressure using the seal formed by the sealing ring; lowering the shaft such that the packing material forms a seal between the pack box and shaft, wherein the lowering of the shaft forms a clearance between the sealing ring and the pack box, and rotating the shaft during operation of the digester, wherein the shaft is sealed by the pack box and the sealing ring is separated from the pack box.

DETAILED DESCRIPTION OF THE INVENTION

Figure 1:
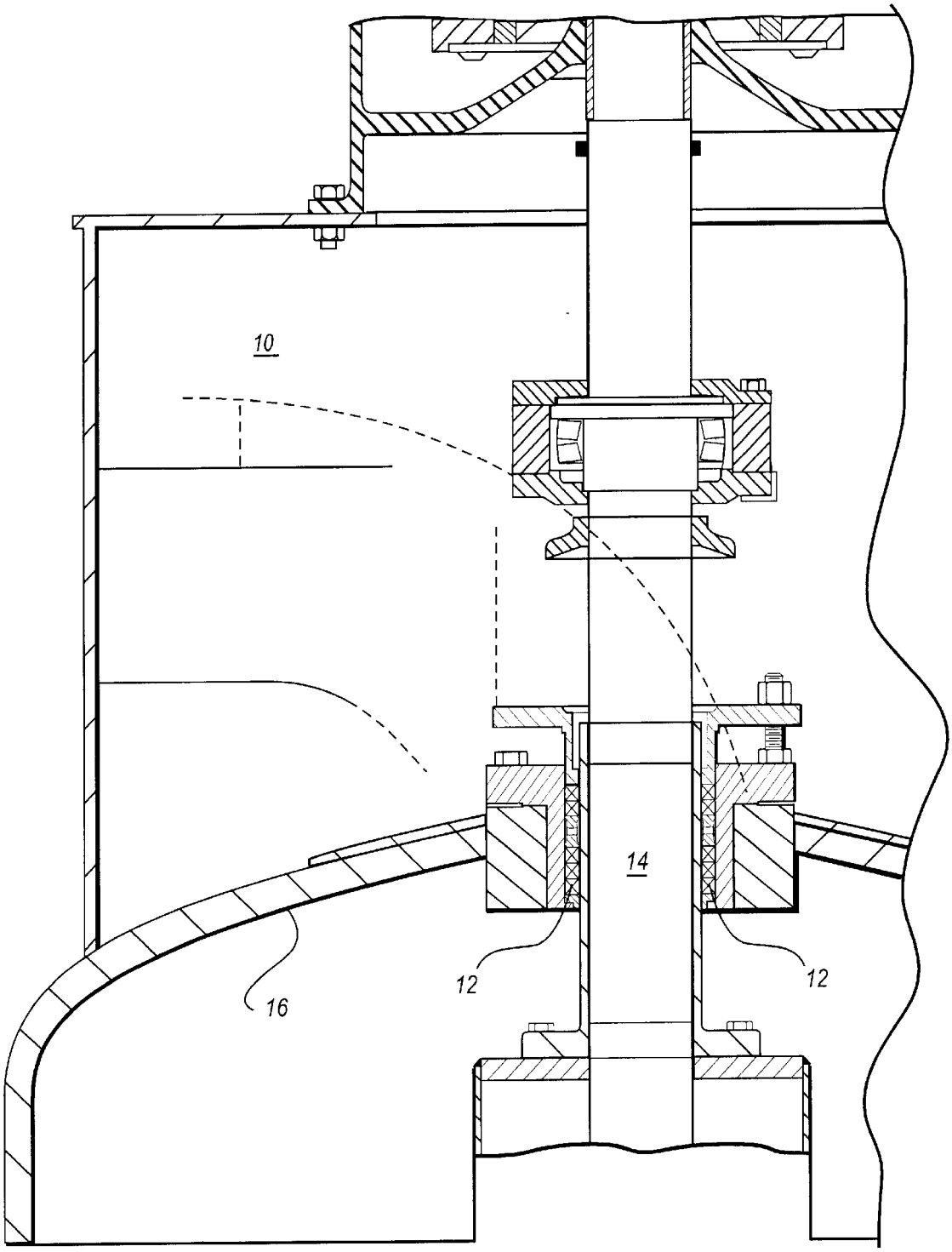
FIG. 1 is a partial cross-sectional view and partial elevational view of a portion of a side of a conventional top separator mounted on a digester vessel.
Figure 2:
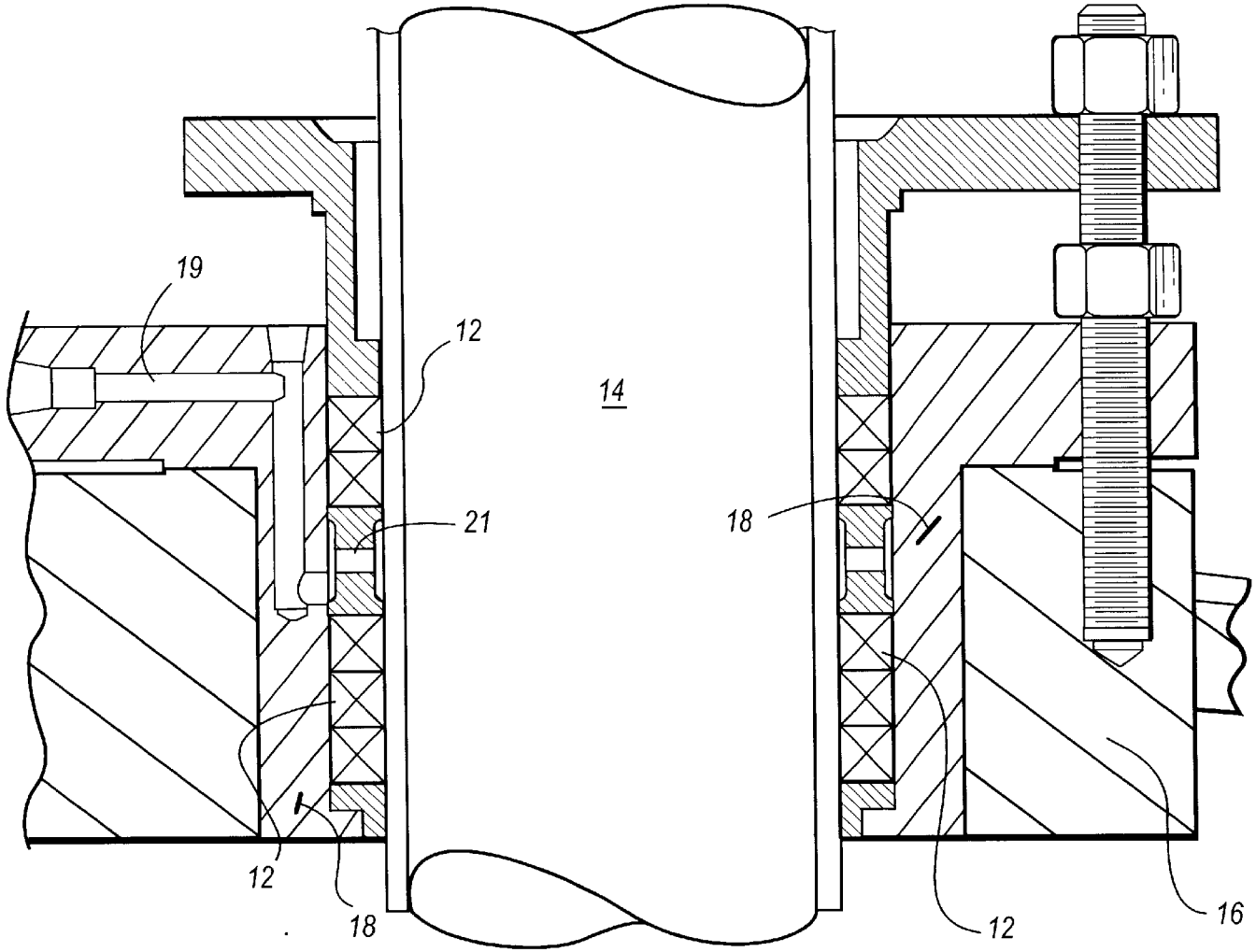
Fig. 2 (PRIOR ART)
FIG. 2 is a close-up view of a partial cross-sectional view and partial elevational view of a side of a conventional pack box for the top separator shown in FIG. 1.
Figure 3:
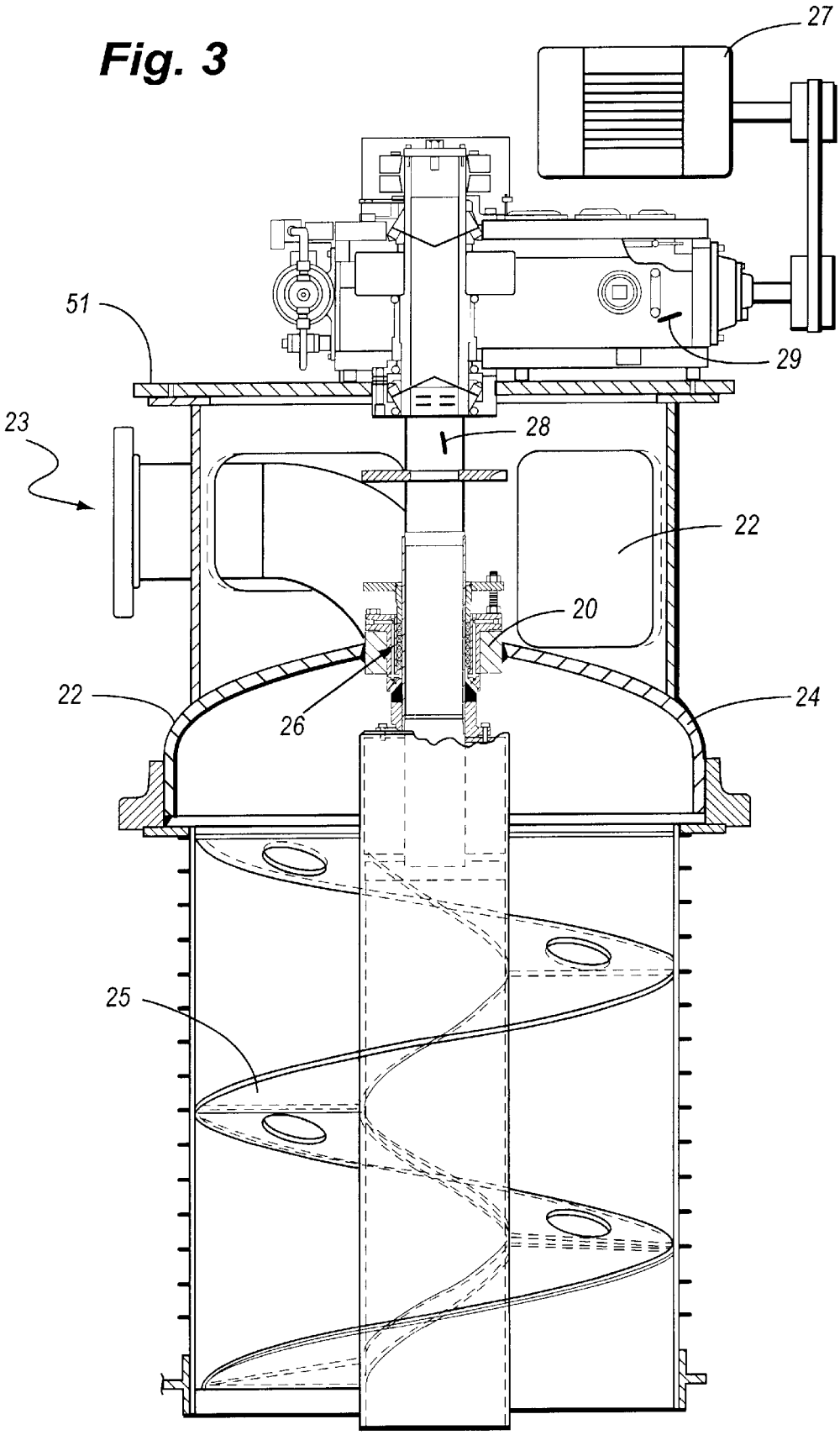
FIG. 3 is a partial cross-sectional view and partial elevational view of a side of a top separator mounted on a digester vessel with a pack box and sealing ring.

FIG. 3 shows a packing 20 for a top separator 22 of a digester vessel 24. The top separator 22 is a cylindrical housing on top of the digester vessel 24 having an inlet chute 23 to receive a slurry of cellulosic fibrous material. The chute directs the slurry into the separator screw conveyor 25 that extends generally vertically down into the digester vessel 24. The screw conveyor is turned by the vertical separator shaft 28. This shaft is turned by a motor 27 through a gearbox 29 which is mounted to the top of the top separator 22. The shaft extends down through the top separator and enters the digester vessel 24 through a pack box 26. The pack box contains the packing 20 that provides a seal between the rotating separator shaft and the stationary digester vessel. This seal assists in maintaining a pressure in the vessel so that the slurry can be processed under pressure in the digester vessel.

Figure 4:
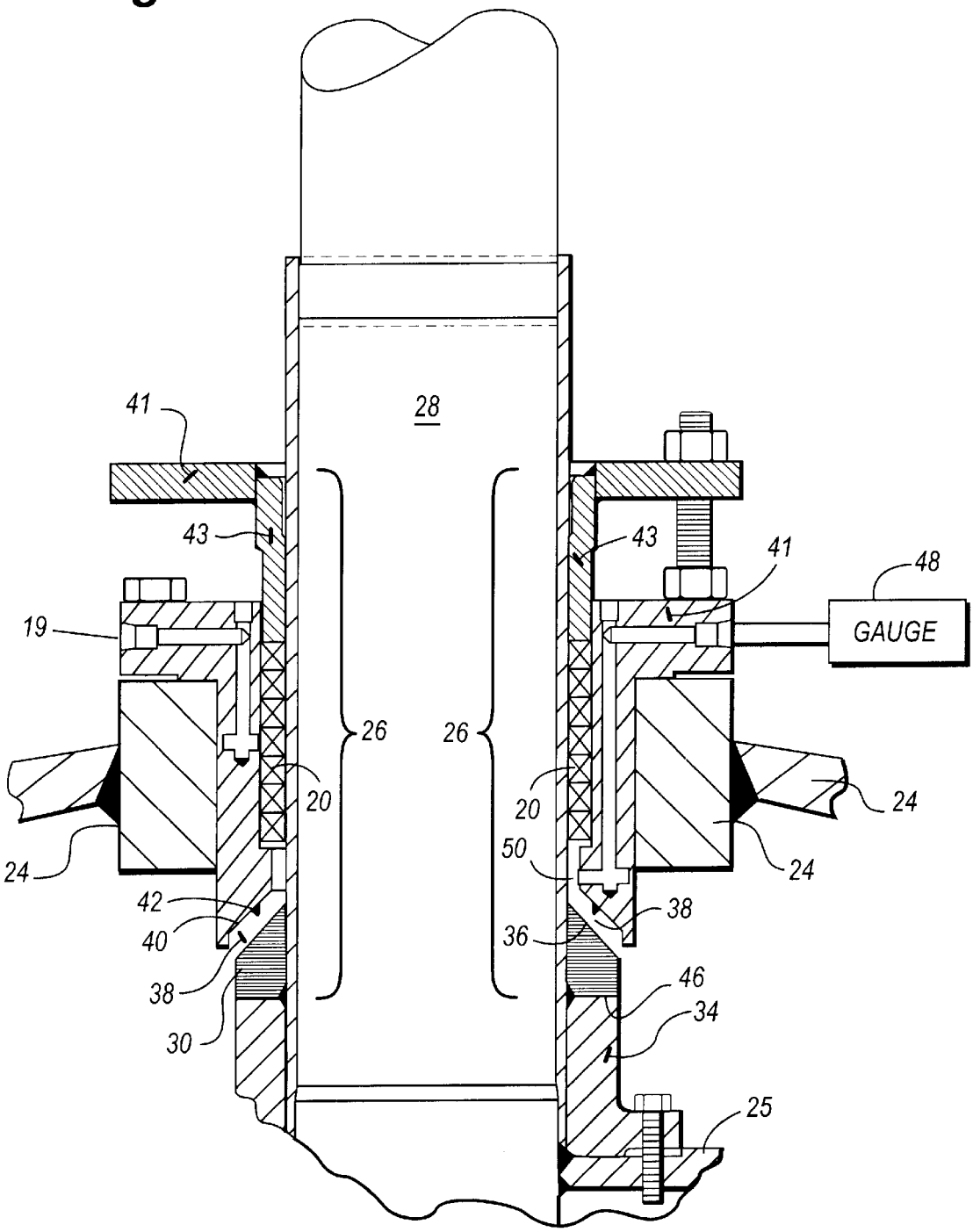
FIG. 4 is a close-up partial cross-sectional view, and partial elevational view of a side of the pack box and sealing ring shown in FIG. 3.

FIG. 4 shows a side detail view partly in cross-section and partly in elevation of the pack box 26 allows one to change the packing without emptying the digester. The pack box assembly 26 provides, associated with a top separator shaft 28, a particularly-configured sealing ring 30 at, adjacent, or close to the pack box 26. The sealing ring may be formed of a polytetraflouroethylene (PTFE) containing material, 25% glass filed Teflon™ material, an elastomer or some other material that provides a pressurized seal between the pack box and a stationary separator shaft. The ring 30 is held in place by a shoulder 46 of the top separator shaft sleeve 34.

The ring 30 preferably includes a tapered (e.g., frustoconical) top surface 36. The sealing ring 30 may be mounted on a shoulder 46 of a sleeve for the shaft, and the ring may have a substantially frustoconical top sealing surface 36. The bottom rim 40 of the packing box gland 41 may have a substantially frustoconical surface that is substantially complementary to said sealing ring top surface.

During normal digester operation, a nominal clearance 38 exists between the sealing ring 30 and the bottom 40 of the gland 41 of the pack box 26. During normal digester operation, the sealing ring does not engage or seal against the pack box.

The pack box housing 41 provides an outer cylindrical wall for the packing. The gland is stationary, as is the packing. The packing 20 is also contained in a pack box assembly 26. Because of the clearance, the sealing ring does not form a seal and, thus, is inoperative during normal digester operation. The bottom 40 of the pack box housing may have a surface configuration complimentary to that of the top surface 36 of the sealing ring 30. A seal-enhancing protruding ridges 42 may be provided on the bottom 40 of the pack box. The protruding ridge 42 may be a series of annular serrations on a surface of the annular surface of the bottom 40 of the pack box.

Figure 5:
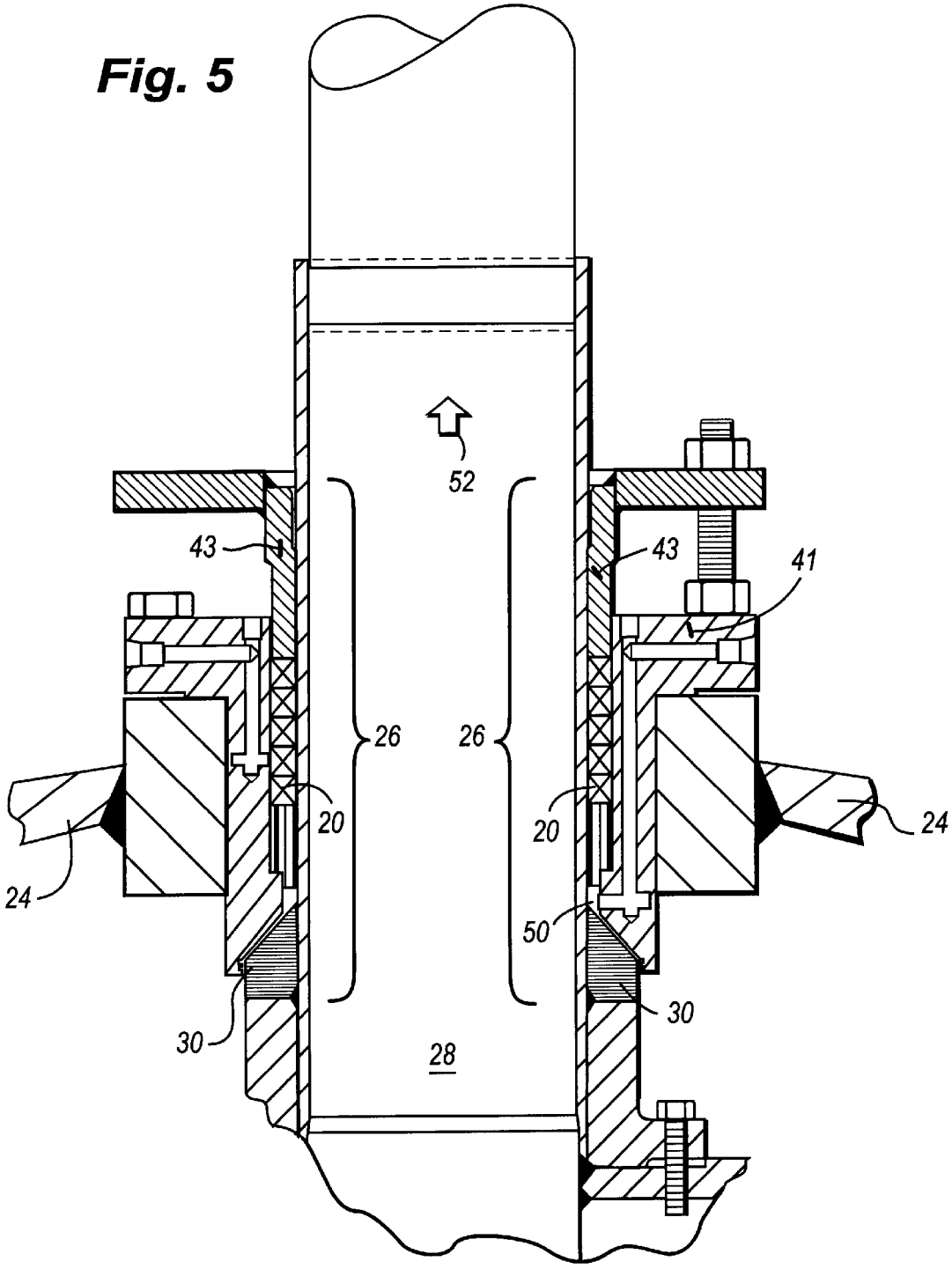
FIG. 5 is a close-up cross-sectional side view of the pack box shown in FIG. 3, wherein the sealing ring provides a seal between the pack box and digester vessel.

When it is desired to change or refurbish the packing 20, the shaft 28 stops rotating and is then lifted using the lifting plate 51 shown in FIG. 3. As the shaft is lifted 52, the seal ring 30 is pinched between the bottom 40 of the pack box and an annular ledge 46 of the shaft sleeve 34, as shown in FIG. 5. The pinched sealing ring forms a substantially fluid-tight seal between the seal ring top surface 36 and the pack box housing bottom 40 of the pack box. A fluid tight seal is also formed between the ledge 46 of the shaft sleeve. When the digester is fully sealed by the pinched sealing ring, the packing 20 of the pack box may be replaced or refurbished. To assess the packing, the pack box housing follower 43 is slid up the shaft. The packing 20 is removed, one ring at a time until all rings have been removed. Next, new rings of packing are installed.

The seal provided by sealing the ring between the surfaces seals the pack box housing 41 and packing from the super atmospheric pressure inside the digester vessel. A pressure gauge 48—shown schematically in FIG. 6—may be connected to the cavity 50 of the pack box housing 41 which provides fluid access to the bottom of the packing. As shown in FIGS. 4 and 5, the cavity 50 becomes sealed when the sealing ring engages the packing box. The pressure in the pack box cavity is measured to determine if and when it is safe to work on the pack box, and to confirm that the sealing ring is providing a good seal between the shaft and pack box. A high pressure indicated on the gauge may indicate that the cavity is not sealed. A low pressure may indicate the sealing device did work and the cavity is isolated from digester pressure.

Figure 6:
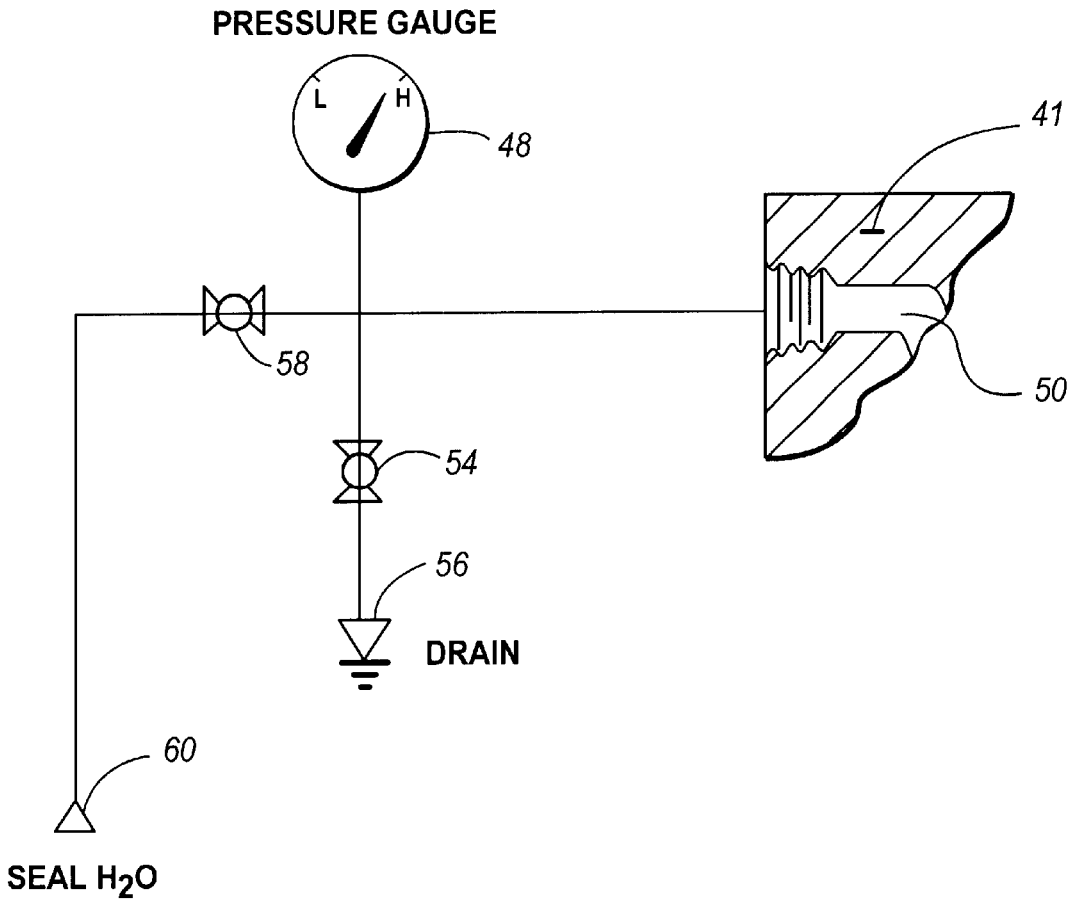
FIG. 6 is a schematic diagram of a fluid valve and pressure valve system for the pack box shown in FIG. 3.

As shown in FIG. 6, the pressure gauge 48 may be included in the top separator 22, or the gauge may be external to the separator and may transmit signals externally of the digester which are readily read by an operator so positioned. Any suitable conventional pressure gauge 48 may be used. A valve 54 for a fluid drain 56 in the piping may be available to release excess pressure. A valve 58 may provide a connection to a source of pressurized water 60.

Once it is determined that the pressure in the pack box is safe, the internal components (packing 20) may be replaced. When the packing has been replaced in a conventional manner, the upward force 52 on the shaft 28 is released, and the shaft is lowered slightly downward into its operational position in the separator. The shaft sleeve and sealing ring, 30 returns to the position illustrated in FIG. 3, with a clearance 38 between the surfaces of the ring 30 and bottom 40 of the pack box.

Conventionally, twenty-eight or more hours is needed to empty a digester, replace the packing, re-fill the digester, batch cook the contents, and then start-up continuous operation again, for conventional top separators. It is expected that this turnaround time can be reduced to about six hours using the sealing ring configuration disclosed herein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A top separator assembly for a digester, comprising:

a rotatable shaft for the top separator assembly mounted on top of the digester;

a pack box including packing mounted around the shaft wherein said pack box includes a first annular surface around said shaft; and a sealing ring mounted on the shaft and having a nominal clearance with the pack box, said sealing ring mounted so that up-lifting of said shaft provides a substantially fluid-tight seal between said pack box, said ring and the digester, and said sealing ring has a second annular surface which abuts against said first annular surface when said shaft is an up-lifted position, wherein said first or second annular surface includes an annular ridge in sealing engagement with said second or first annular surface, when said shaft is in said up-lifted position.

2. A top separator assembly as in claim 1 wherein said pack box includes an annular surface opposite to said sealing ring, and said annular surface engages said sealing ring when the shaft is up-lifted.

3. A top separator as in claim 1 wherein said shaft includes a ledge to receive said sealing ring, and said ledge has at least one annular ring to engage said sealing ring.

4. A top separator assembly as in claim 1 wherein said pack box includes an annular surface opposite to said sealing ring, and said annular surface engages said sealing ring when the shaft is up-lifted.

5. A top separator assembly as in claim 1 wherein the digester receives a slurry of cellulosic fibrous material through said top separator.

6. A top separator assembly as in claim 1 wherein said rotatable shaft extends vertically through said top separator and into said digester.

7. A top separator assembly as in claim 1 wherein said sealing ring is formed of a soft sealing material.

8. A top separator assembly as in claim 1 wherein said sealing ring is an annulus having a generally trapezoidal cross section.

9. A top separator assembly as in claim 1 wherein said shaft includes a shaft sleeve, and said sleeve includes a ledge supporting said sealing ring.

10. A top separator assembly for a digester, comprising:

a rotatable shaft for the top separator assembly;

a pack box including packing mounted around the shaft;

a sealing ring mounted on the shaft and having a nominal clearance with the pack box, said sealing ring mounted so that up-lifting of said shaft provides a substantially fluid-tight seal between said pack box, said ring and the digester;

wherein said pack box includes an annular surface opposite to said sealing ring, and said annular surface engages said sealing ring when the shaft is up-lifted, and wherein said annular surface of the pack box includes at least one ridge that bites into said sealing ring when the shaft is up-lifted.

11. A top separator as in claim 10 wherein said ridge is serrated.

12. A top separator for a digester, comprising:

a rotatable shaft for the top separator assembly;

a pack box including packing mounted around the shaft;

a sealing ring mounted on the shaft and having a nominal clearance with the pack box, said sealing ring mounted so that up-lifting of said shaft provides a substantially fluid-tight seal between said pack box, said ring and the digester;

wherein said shaft includes a ledge to receive said sealing ring, and said ledge has at least one annular ring to engage said sealing ring, and wherein said annular ring on the ledge is serrated.

13. A top separator assembly as in claim 12 wherein said sealing ring further comprises an inner cylindrical surface mounted against an annular surface of said shaft, wherein said annular surface is adjacent said ledge of the shaft.

14. A top separator assembly for a digester, comprising:

a rotatable shaft for the top separator assembly;

a pack box including packing mounted around the shaft;

a sealing ring mounted on the shaft and having a nominal clearance with the pack box, said sealing ring mounted so that up-lifting of said shaft provides a substantially fluid-tight seal between said pack box, said ring and the digester;

wherein said pack box includes an annular surface opposite to said sealing ring, and said annular surface engages said sealing ring when the shaft is up-lifted, and wherein said annular surface of the pack box includes at least one ridge that bites into said sealing ring when the shaft is up-lifted.

15. A top separator assembly for a digester, comprising:

a rotatable shaft for the top separator assembly;

a pack box including packing mounted around the shaft;

a sealing ring mounted on the shaft and having a nominal clearance with the pack box, said sealing ring mounted so that up-lifting of said shaft provides a substantially fluid-tight seal between said pack box, said ring and the digester;

wherein said sealing ring has an upper surface and a lower surface, and said sealing ring upper surface is opposite to a lower annular surface of said pack box and said sealing ring lower surface is opposite to an annular ledge of said shaft.

* * * * *